US012702203B2

(12) United States Patent
Dias et al.

(10) Patent No.: US 12,702,203 B2
(45) Date of Patent: Aug. 11, 2026

(54) ARTICLE OF JEWELRY

(71) Applicant: CHOPARD TECHNOLOGIES SA, Fleurier (CH)

(72) Inventors: Francisco Dias, Saint-Sulpice (CH); Sergio Dos Santos, Fleurier (CH)

(73) Assignee: CHOPARD TECHNOLOGIES SA, Fleurier (CH)

( * ) Notice: Subject to any disclaimer, the term of this patent is extended or adjusted under 35 U.S.C. 154(b) by 88 days.

(21) Appl. No.: 18/005,360

(22) PCT Filed: Jun. 24, 2021

(86) PCT No.: PCT/IB2021/055585
§ 371 (c)(1),
(2) Date: Jan. 13, 2023

(87) PCT Pub. No.: WO2022/013651
PCT Pub. Date: Jan. 20, 2022

(65) Prior Publication Data

US 2023/0263278 A1 Aug. 24, 2023

(30) Foreign Application Priority Data

Jul. 14, 2020 (CH) ..... 00861/20

(51) Int. Cl.
*A44C 17/02* (2006.01)

(52) U.S. Cl.
CPC ..... *A44C 17/0291* (2013.01)

(58) Field of Classification Search
CPC . A44C 17/0291; A44C 25/00; A44C 17/0241; A44C 17/025; A44C 17/0257;
(Continued)

(56) References Cited

U.S. PATENT DOCUMENTS 1,730,257 A * 10/1929 Welch ..... A44C 25/002 63/26
5,006,375 A * 4/1991 Mangan ..... A47G 33/08 40/406

(Continued)

FOREIGN PATENT DOCUMENTS

CH 696794 A5 * 12/2007 ..... A44C 17/0291
CH 710682 A1 * 8/2016 ..... A44C 17/0291

(Continued)

*Primary Examiner* — Jason W San
*Assistant Examiner* — Anna S Rashid
(74) *Attorney, Agent, or Firm* — Studebaker Brackett PLLC

(57) ABSTRACT

An article of jewelry is proposed, comprising at least one transparent wall forming a housing arranged to receive at least one precious or semi-precious stone immersed and movable in a substantially transparent liquid in the housing, and at least one part movable in the liquid and having the same refractive index as the liquid, the movable part immersed in the liquid being substantially optically indiscernible. The housing is delimited by two walls, of which the internal faces are preferably parallel to each other. The stone is inserted into the part to form a movable decorative element, the movable part immersed in the liquid being substantially optically indiscernible and comprising an axis of revolution and two guide surfaces adjacent respectively to the internal faces and allowing said movable decorative element to move freely in translation and in rotation in the liquid around said axis of revolution inside the housing.

20 Claims, 7 Drawing Sheets

(58) Field of Classification Search
CPC ..... A44C 17/0275; A44C 17/0283; A44C 17/0258; G04B 45/0023
See application file for complete search history.

(56) References Cited

U.S. PATENT DOCUMENTS 5,189,821 A * 3/1993 Lee ..... G09F 19/02 40/406
5,272,681 A * 12/1993 Lee ..... G04B 45/0061 368/76
5,292,564 A * 3/1994 Lee ..... G09F 19/02 40/406
5,652,736 A * 7/1997 Lee ..... G04B 37/0016 368/286
6,226,232 B1 * 5/2001 Ruchonnet ..... G02C 11/02 63/31
6,244,772 B1 * 6/2001 Ruchonnet ..... B43K 5/005 401/52
6,324,868 B1 * 12/2001 Chen ..... A44C 25/002 63/23
6,324,869 B1 * 12/2001 Vanlioglu ..... A44C 17/0291 63/26
6,349,492 B1 * 2/2002 Lee ..... G09F 19/08 40/406
6,766,658 B2 * 7/2004 Scharf ..... A44C 17/02 63/26
7,823,415 B2 * 11/2010 Gruosi-Scheufele ..... A44C 17/0291 63/15
8,869,556 B2 * 10/2014 Asscher ..... A44C 27/00 63/15
10,362,844 B2 * 7/2019 Bove ..... G04B 47/044
10,967,670 B2 * 4/2021 Wong ..... B44C 5/005
11,849,817 B2 * 12/2023 Reginelli ..... A44C 17/025
2005/0160765 A1 * 7/2005 Hintze ..... A44C 17/0275 63/26
2008/0173045 A1 * 7/2008 Turner ..... A44C 25/002 40/406
2010/0017944 A1 * 1/2010 Hirschmann ..... A44C 27/00 63/26
2013/0276479 A1 * 10/2013 Noyes ..... A44C 17/0283 29/896.41
2017/0172265 A1 * 6/2017 Leuz ..... G04B 47/044
2018/0000208 A1 * 1/2018 Bove ..... A44C 17/0291
2018/0295953 A1 * 10/2018 Vouillamoz ..... A44C 5/0007
2018/0332931 A1 * 11/2018 Wong ..... B44C 5/005
2019/0041800 A1 * 2/2019 Husson ..... G04B 45/0076
2019/0289969 A1 * 9/2019 Lin ..... A44C 17/0275
2021/0386165 A1 * 12/2021 Reginelli ..... A44C 25/00
2022/0183428 A1 * 6/2022 Reginelli ..... G04B 45/0023
2024/0122312 A1 * 4/2024 Napoli ..... A44C 5/0053
2024/0156220 A1 * 5/2024 Reginelli ..... G04B 45/0023

FOREIGN PATENT DOCUMENTS

CH 712113 B1 * 10/2019 ..... G04B 45/0076
CH 710682 B1 * 2/2020 ..... A44C 17/0291
CN 111345549 A * 6/2020 ..... A45D 8/002
DE 102018133485 B3 * 11/2019 ..... G09F 19/02
EP 0965071 A1 12/1999
EP 0965071 B1 * 11/2004
JP 2002512682 A * 4/2002 ..... G04B 47/044
JP 2018510676 A * 4/2018 ..... A44C 17/0291
WO WO-2015150910 A2 * 10/2015 ..... G09F 13/24
WO WO-2016120712 A1 * 8/2016 ..... A44C 17/0291
WO WO-2017141198 A1 * 8/2017 ..... B44F 1/066
WO WO-2019016697 A1 * 1/2019 ..... G04B 47/044
WO WO-2020070667 A1 * 4/2020 ..... G04B 45/0023
WO WO-2020070667 A9 * 10/2020 ..... A44C 15/0015
WO WO-2020201993 A1 * 10/2020 ..... G04B 47/044
WO WO-2021055585 A1 * 3/2021 ..... G06V 10/82

* cited by examiner

ARTICLE OF JEWELRY

CROSS-REFERENCE TO RELATED APPLICATIONS

The present patent application is a National Phase filing of International Application No. PCT/IB2021/055585, filed on Jun. 24, 2021, which claims priority to Swiss National Application No. CH00861/20 filed Jul. 14, 2020, the disclosures of which are incorporated in their entirety by reference herein.

TECHNICAL FIELD

The present invention relates to movable decorative elements intended to be moved in rotation and translation in articles of jewelry, in particular rings and pendants, and also in utilitarian articles decorated with movable decorative elements, in particular watches, spectacle frames, or luxury leatherwear articles.

BACKGROUND OF THE INVENTION

The mobility of decorative elements in a timepiece or in a piece of jewelry, when its user makes a movement and causes it to move, offers a strong esthetic effect and gives an additional visual appeal to the timepiece or the piece of jewelry, emphasizing its value all the more. It is known to arrange, around the dial of a timepiece, or even above the latter, elements of jewelry such as stones, or even stones mounted in cabochons, which have at least one degree of freedom, in a channel or a closed space in which these jewelry elements are movable.

In addition, precious or semi-precious stones have been integrated into a liquid. U.S. Pat. No. 1,730,257A describes an improvement to a composite gem of the type comprising a group of a multiplicity of small gems immersed and movable in a substantially transparent liquid in a substantially transparent housing in which the liquid spaces the small gems apart when they are set in motion therein. The improvement consists of a plurality of substantially transparent spacers intermingled with the small gems and movable in liquid and having the property with respect to liquid that renders them substantially optically indiscernible when they are in the liquid.

The applicant, having great expertise in the implementation of articles comprising movable decorative elements, seeks to obtain an entirely different technical effect.

SUMMARY OF THE INVENTION

The object of the present invention is to propose an article of jewelry comprising a precious or semi-precious stone arranged in a movable part in order to constitute a decorative element movable in a liquid, in such a way that the movement of the movable decorative elements and the spinning effect are slowed down in order to visualize these movements in slow motion, like a video slow motion effect.

According to the invention, an article of jewelry comprises at least one transparent wall forming a housing arranged to receive at least one precious or semi-precious stone immersed and movable in a substantially transparent liquid in the housing, and at least one part movable in the liquid and having the same refractive index as the liquid, the movable part immersed in the liquid being substantially optically indiscernible. The housing is delimited by two walls, of which the internal faces are preferably parallel to each other. The stone is inserted into the part in order to form a movable decorative element, the movable part immersed in the liquid being substantially optically indiscernible and comprising an axis of revolution and two guide surfaces adjacent respectively to the internal faces and allowing said movable decorative element to move freely in translation and in rotation in the liquid around said axis of revolution inside the housing.

By virtue of the present invention, the movable decorative element arranged in a liquid makes it possible to create a special effect such that the movement of the movable decorative elements and the spinning effect are slowed down so as to visualize these movements in slow motion, like a video slow motion effect which consists in filming by accelerating the frame rate so that the movement reproduced is slowed down on projection.

In one embodiment, the stone is inserted into a movable part forming a socket surrounding the stone.

In order to be invisible, each space between the interior of the movable part and the stone is filled with the liquid.

In one embodiment, the movable part is arranged to receive a plurality of stones. According to this embodiment, it is an assembly of stones that moves and turns on itself.

In this embodiment, the stones have different densities and are arranged so as to orient the movements of the movable part.

In one embodiment, the movable part has a drag coefficient (Cx) in the liquid which determines the movement of the movable decorative element.

In order to accelerate the slowed rotation of the movable decorative element, the movable part comprises fins (7, FIG. 7) arranged on its circumferential periphery. The socket has fins (7) in order to promote a rotation (spinning effect) during its movement by translation, whereas the effect of the decorative element movable in the liquid is generally to slow down this spinning effect.

To amplify the optical effect, the movable decorative element can be arranged to move in a corridor or along a path defined by protrusions or hollows arranged on at least one of said walls. The walls created by these protrusions or these hollows can be made invisible in the liquid, which makes the effect even more spectacular insofar as the decorative element cannot leave its perimeter or follow a path other than the one defined, without the wearer being able to see the corridors or the path that are made invisible. For example, the protrusions or hollows can be of glass, the liquid of glycerin, and the crystal of one of said two walls of sapphire. In this embodiment, the movable decorative element thus moves only within a restricted perimeter, whereas it could appear to be able to move within the whole housing.

In another embodiment, the stone is held in the part by a plurality of arms which extend above a body of the part and which set the stone, these arms leaving between them, and above the body of the part, lateral openings allowing the sides of the stone, between the arms, to be in direct contact with the liquid, and the guide surface is formed by the free ends of the arms in the form of separate contact zones spaced apart from one another around the periphery of the open external face of the part.

In one embodiment, the decorative element can consist of a bottomless hollow cylinder and a stone.

The stone can be a precious stone, in particular a diamond, or a semi-precious stone.

The movable decorative elements consist of a precious or semi-precious stone and of the part whose shape is corresponding, for example cylindrical, oval, square, triangular or asymmetrical.

In one embodiment, the clearance between the height of the movable decorative element and the opposite internal faces of the walls is from 0.05 to 0.3 mm and preferably from 0.05 to 0.1 mm.

In one embodiment, the parallel internal faces of the walls are flat. In a variant, however, the parallel internal faces of the walls are curved.

The decorative article of the present invention can be in the form of a watch; a writing instrument; a jewel; a spectacle frame; or a fine-leatherwear article.

BRIEF DESCRIPTION OF DRAWINGS

The features of the invention will become more clearly apparent from reading the description of several embodiments, given solely by way of entirely non-limiting example, and by reference to the schematic figures, in which.

DETAILED DESCRIPTION

Figure 1:
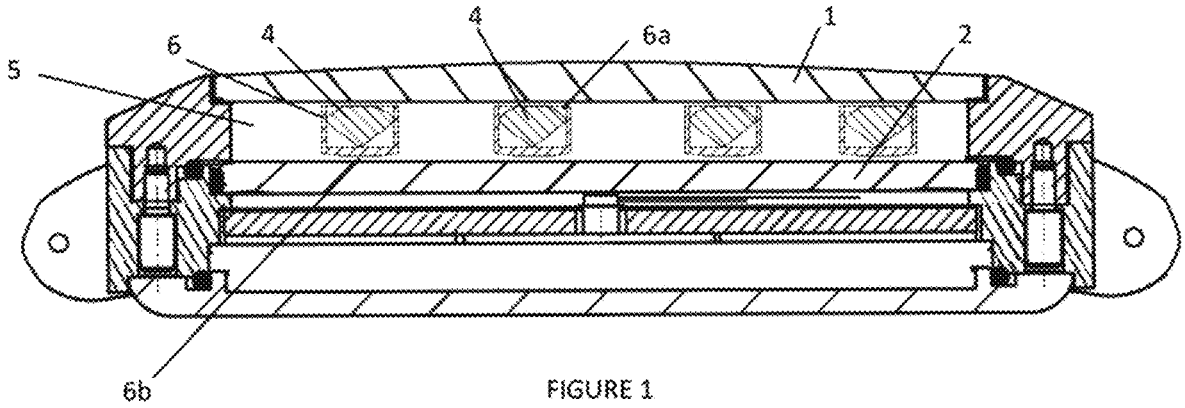
FIG. 1 shows a sectional view of a wristwatch in which are inserted, between two walls, four movable decorative elements immersed in a liquid.

As is illustrated in FIG. 1, a watch shown in cross section comprises a movement fitted with a dial, housed in a casing comprising a middle part closed, on the one hand, by a back cover and, on the other hand, by a crystal 1. A second crystal 2 is arranged between the crystal 1 and a dial.

In this example, the respective internal faces of each crystal 1 and 2 are applied against a bearing surface of the internal face of parts constituting a watch casing, leaving between them a free space of determined height and filled with a liquid 5. In this example, the respective internal faces of the crystals 1, 2 are strictly flat. In a variant not shown, the respective internal faces of the crystals 1, 2 may have a slight curvature formed by one or more radii of curvature, around one or more centers or axes of curvature, in particular according to different cutting planes as per EP0965071. In this case, the respective curvatures given to these two internal faces 1, 2 are strictly identical with respect to each other, such that the height of the free space formed between them remains constant.

Preferably, the watch crystal 1 also comprises a device (not shown) for compensating for the thermal expansion of the liquid 5 in order to compensate for the variations in volume of the liquid that are linked to the temperature. This device can take different forms, such as a flexible membrane, as disclosed in the patent application WO 2015/150910.

Thus, as can be seen in FIG. 1, the watch therefore comprises two transparent walls 1, 2 forming a housing 3 arranged to receive four movable decorative elements 4, 6 immersed and movable in the transparent liquid 5 in the housing 3. Each movable decorative element 4, 6 comprises a socket 6 having the same refractive index as the liquid 5, the socket 6 immersed in the liquid 5 being optically indiscernible. In this example, the socket is made of glass and the liquid is glycerin. Other combinations are also possible. The housing 3 is therefore delimited by the two transparent walls 1, 2 whose internal faces 1*a*, 2*a* (see FIG. 2) are parallel to each other. The socket 6 immersed in the liquid 5 is optically indiscernible and comprises an axis of revolution and two guide surfaces 6*a*, 6*b* respectively adjacent to the internal faces and allowing each of the four movable decorative elements 4, 6 to move freely in translation and in rotation in the liquid about the axis of revolution inside the housing 3.

Thus, the decorative elements movable in the liquid make it possible to create a slowed-down effect during their rotation and movement.

Figure 2:
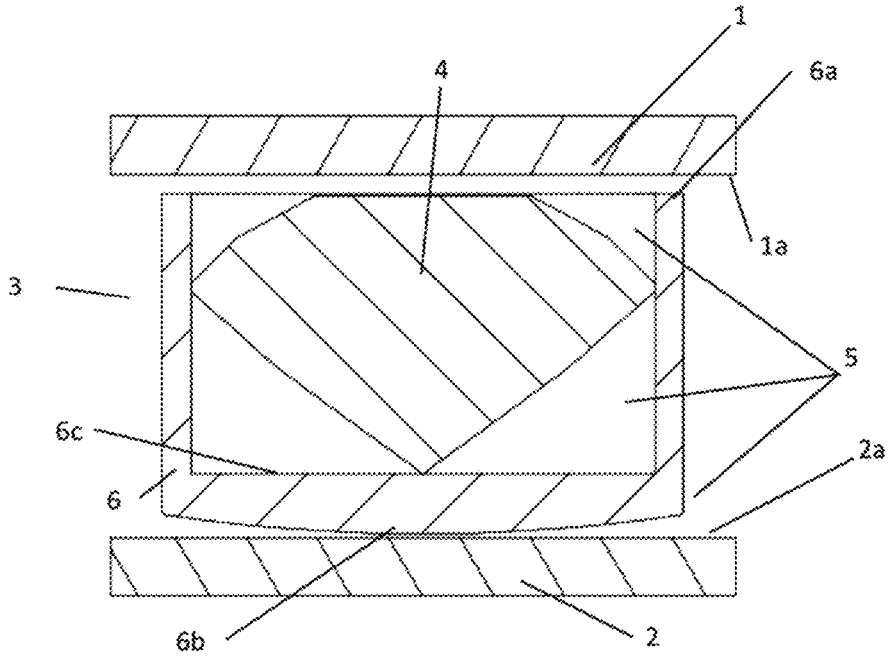
FIG. 2 shows a sectional view of a movable decorative element moved freely in rotation about an axis and in translation between two walls filled with a liquid.

As is illustrated in FIG. 2, in order to make the socket completely invisible, liquid is required in each space between the interior 6*c* of the socket 6 and the stone 4. In a variant not shown, an opening in the socket can allow the liquid to fill the space between the socket and the stone. In yet another variant not shown, it is possible to avoid having liquid in the socket, by combining a socket and a stone in which the interior of the socket perfectly matches the shape of the diamond.

Figure 3A:
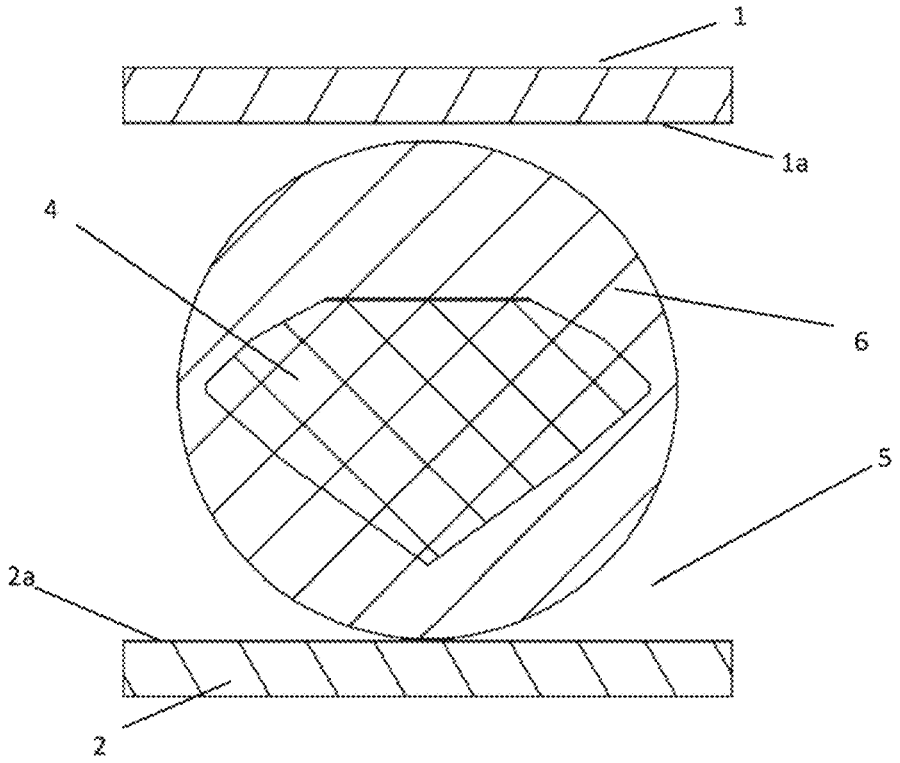
FIGS. 3*a* and 3*b* each show a sectional view of a movable decorative element of round shape moved freely in rotation and in translation between two walls filled with a liquid.
Figure 3B:
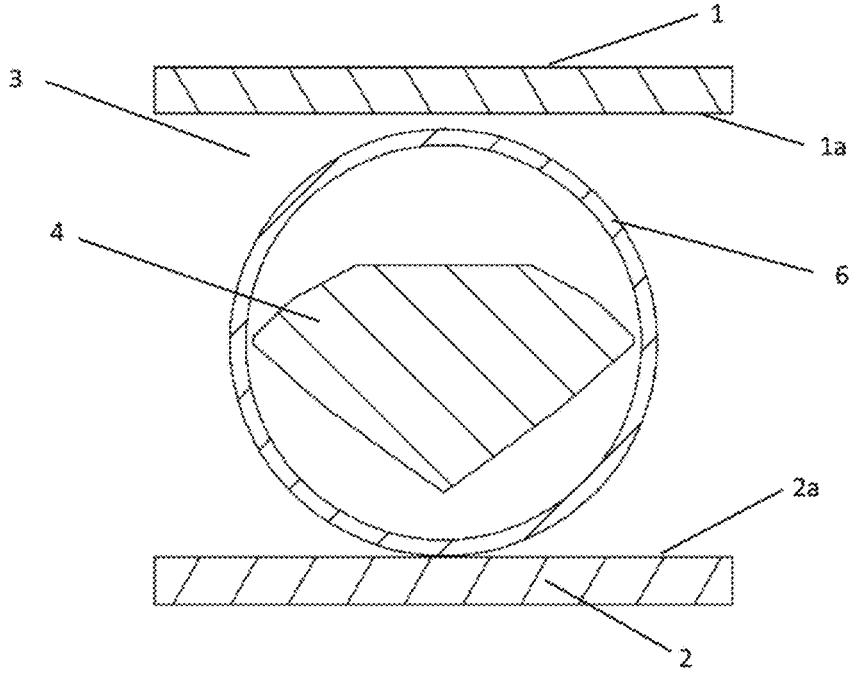

In the example illustrated in FIGS. 3*a* and 3*b*, the socket 6 is in the form of a ball. In the example of FIG. 3*a*, the internal part of the ball matches the diamond 4, and the ball is cast or molded, for example. In the example of FIG. 3*b*, the ball is full of liquid.

Figure 4:
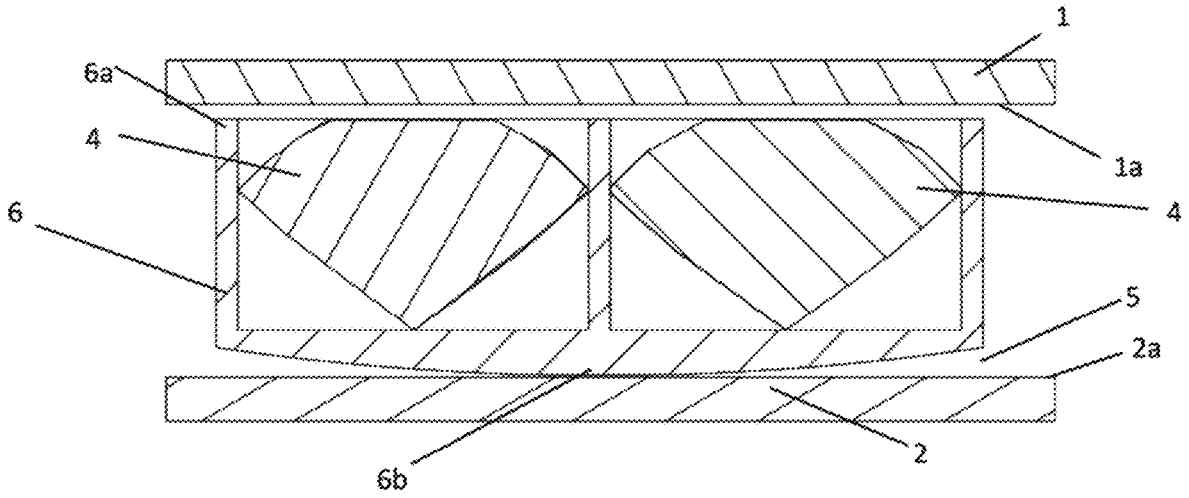
FIG. 4 shows a sectional view of a movable decorative element comprising two stones and moved freely in rotation and in translation between two walls very close together and filled with a liquid.

In the example illustrated in FIG. 4, the socket 6 is arranged to receive a plurality of stones 4. The bottom of the socket 6 is curved.

Figure 5:
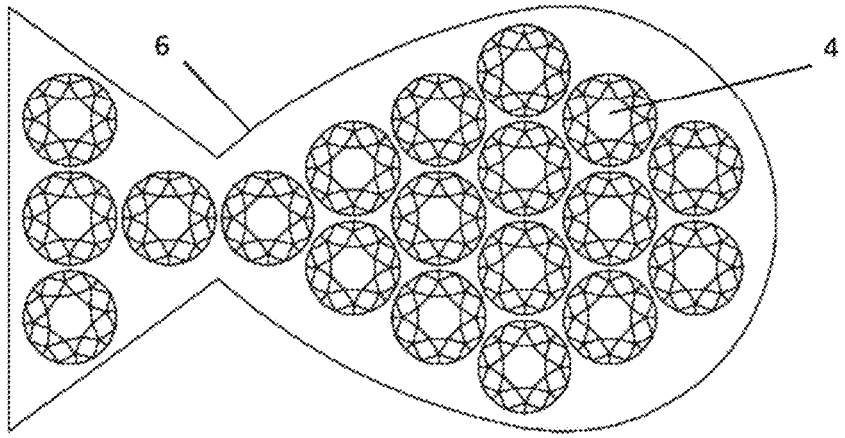
FIG. 5 shows a top view of a movable part in the shape of a fish intended to be moved freely in rotation and in translation between two walls filled with a liquid.

In the example illustrated in FIG. 5, the socket 6 is represented by a fish and comprises a plurality of stones 4, each in a miniature socket 6. In this example, the stones 4 have different densities and are arranged so as to orient the movements of the socket. Thus, by virtue of stones 4 of a different nature, for example with those close to the head of the fish being denser, this would favor a movement of the fish "head forward" and accelerate the rotation of the fish.

Figure 6:
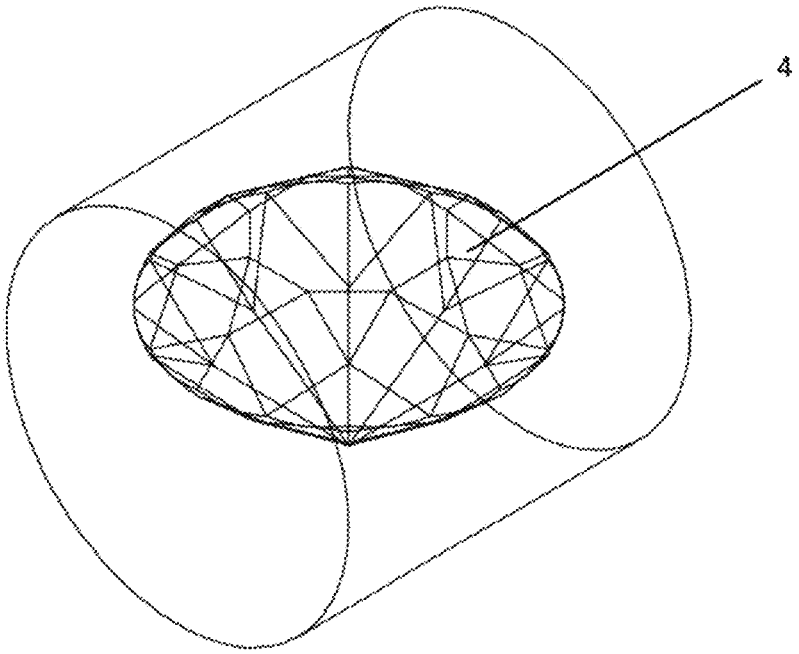
FIG. 6 shows a perspective view of a movable decorative element in the form of a cylinder intended to be moved freely in rotation about an axis and in translation between two walls filled with a liquid.

As is illustrated in FIG. 6, the movable decorative element is cylinder-shaped. Other geometric shapes are also possible.

Figure 7:
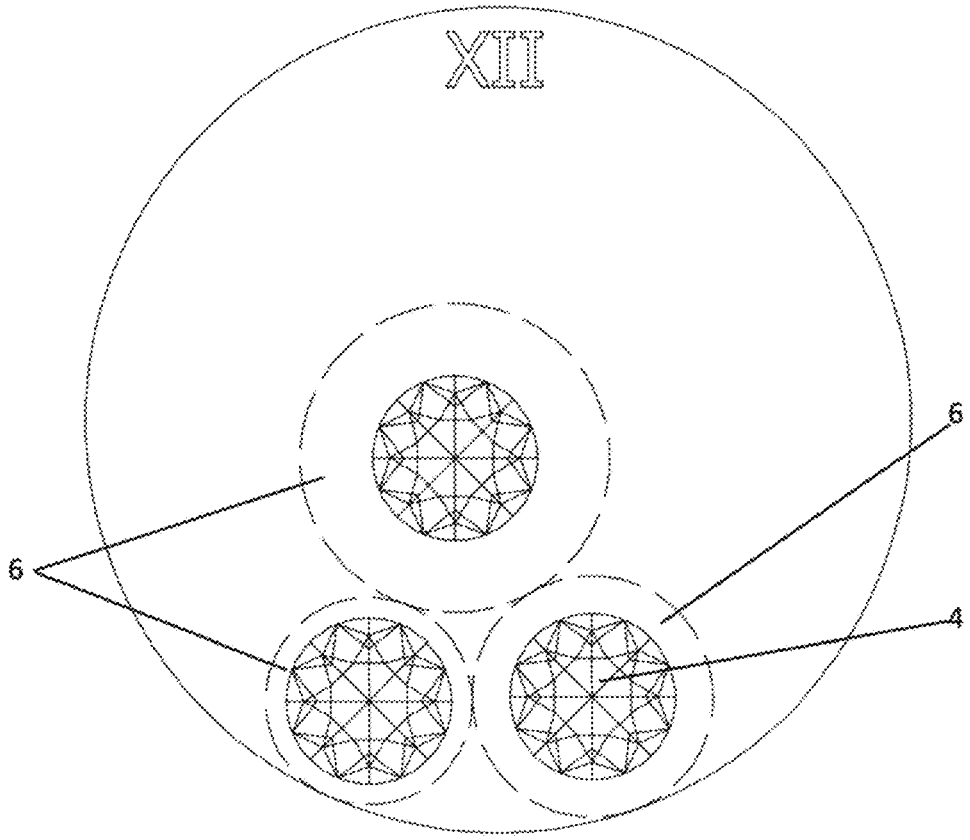
FIG. 7 shows a partial top view of a watch comprising three movable decorative elements of different sizes, spaced apart from one another with the stones not being able to touch, moved freely in rotation and in translation between two walls filled with a liquid.

FIG. 7 shows a partial top view of a watch comprising three movable decorative elements 4, 6 of different sizes moved freely in rotation and in translation between two walls filled with a liquid. In this example, the sockets 6 are of different sizes and invisible, so that the stones cannot touch, thus producing a levitation effect. In a version not shown, a plurality of the movable decorative elements 4, 6 can be associated with one or more sockets 6 not comprising a diamond and serving as a spacer, and as a movement disruptor when the movable decorative elements 4, 6 move, making said movement of the movable decorative elements 4, 6 even more spectacular by virtue of these mysterious displacements.

Figure 8:
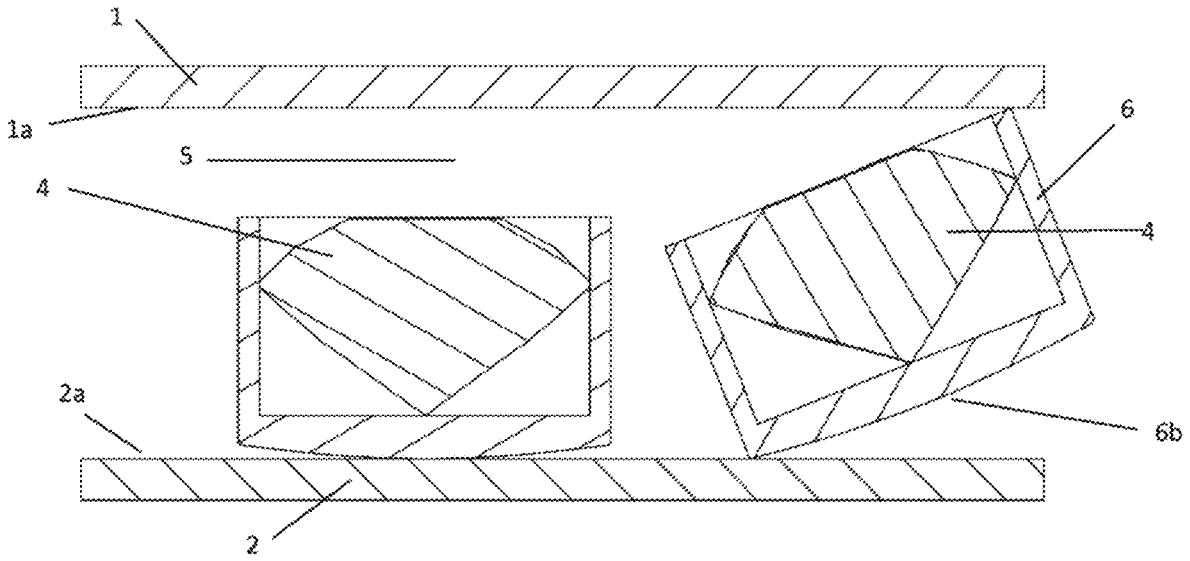
FIG. 8 shows a sectional view of two movable decorative elements comprising two stones and moved freely in rotation and in translation between two widely spaced walls filled with a liquid.

FIG. 8 shows a sectional view of two movable decorative elements 4, 6 comprising two stones 4 and moved freely in rotation and in translation between two widely spaced walls 1, 2 and filled with a liquid 5.

Figure 9:
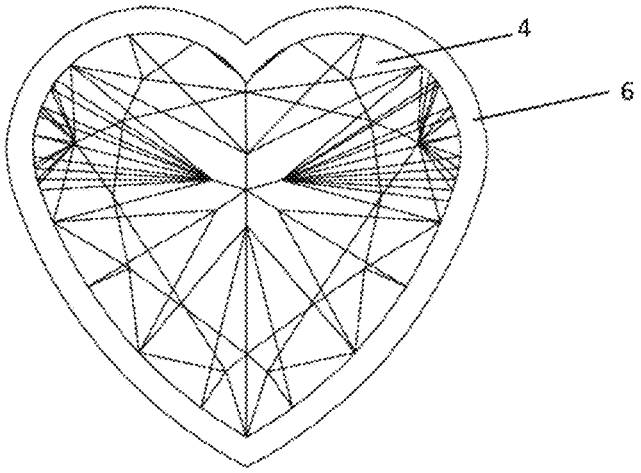
FIG. 9 shows a top view of a heart-shaped movable decorative element intended to be moved freely in rotation and in translation between two walls filled with a liquid.

FIG. 9 shows a top view of a movable decorative element with a heart-shaped stone 4 intended to be moved freely in rotation and in translation between two walls filled with a liquid. In this example, the socket 6 has a drag coefficient Cx in the liquid which determines the movement of the movable decorative element. Thus, the shaped movable part can be designed such that its movement is influenced by its drag coefficient Cx, thus the heart-shaped diamond, in its fall, is oriented preferably on its tip after it has pivoted on itself.

Figure 10:
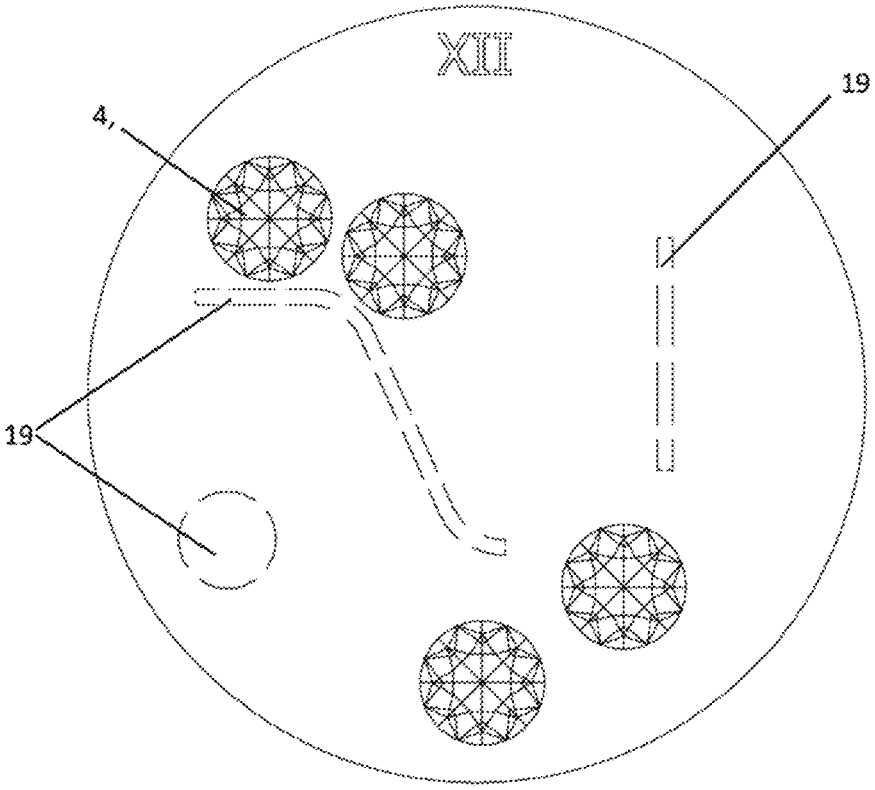
FIGS. 10 and 11 each show a partial top view of a watch comprising movable decorative elements moved freely in rotation and in translation between two walls filled with a liquid and guided by paths or corridors rendered invisible.

FIG. 10 shows a partial top view of a watch comprising movable decorative elements 4, 6 moved freely in rotation and in translation between two walls filled with a liquid and guided by paths 19.

Figure 11:
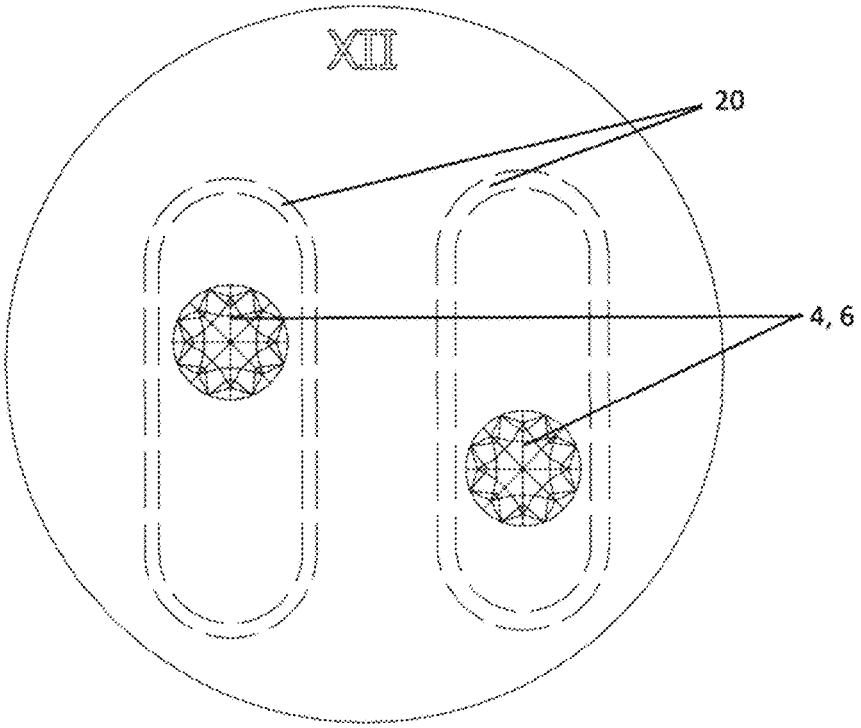

FIG. 11 shows a partial top view of a watch comprising movable decorative elements 4, 6 moved freely in rotation and in translation between two walls filled with a liquid and guided by corridors 20.

Figure 12:
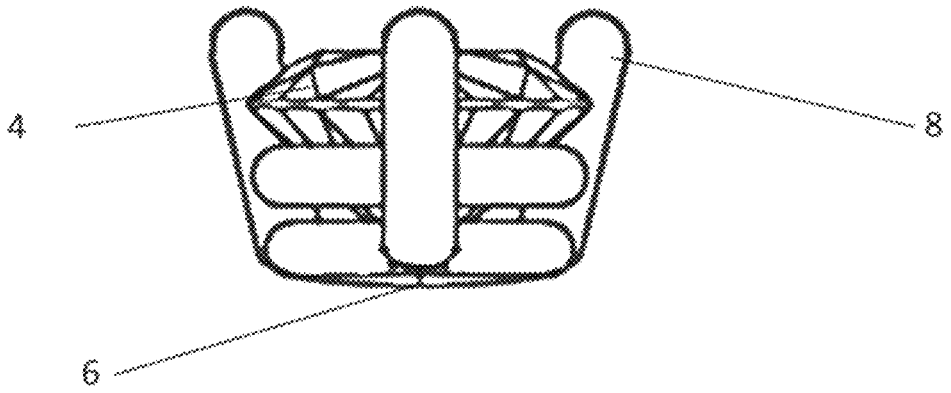
FIG. 12 shows a side view of a movable decorative element comprising an intermediate ring between the convex bottom of the part serving as socket and the end of the arms.

Finally, while in the previous examples the movable decorative elements are mounted in supports in the form of small cylindrical sockets of which the external face of the bottom is convex, FIG. 12 shows a side view of a movable decorative element comprising an intermediate ring between the convex bottom of the part serving as socket and the end of several arms 8 which extend beyond the external face of the stone 4. This very open socket has the advantage that it is not necessary to hollow out the cylindrical socket such that it fills with liquid.

Figure 13:
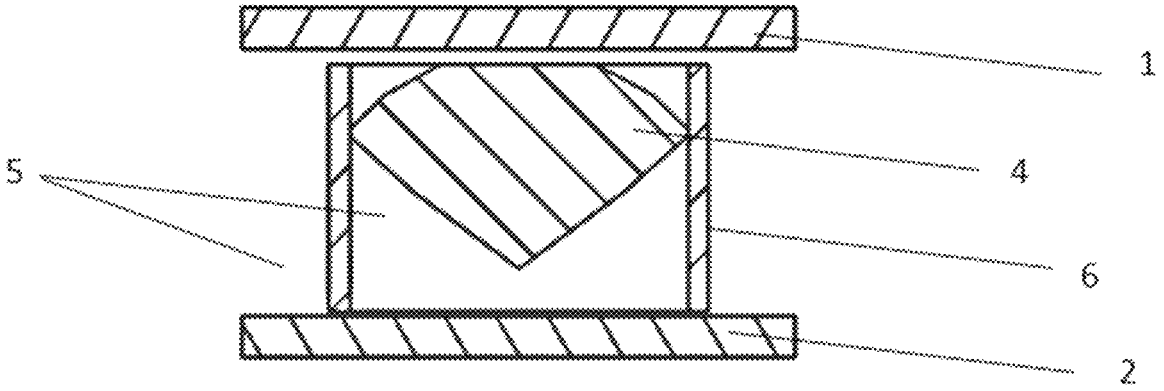
FIG. 13 shows a sectional view of a movable decorative element, consisting of a bottomless socket and a stone, moved freely in rotation and in translation between two walls filled with a liquid.

In the example illustrated in FIG. 13, in order to make the socket completely invisible, liquid is needed in each space between the internal part of the socket 6 and the stone 4. Thus, a bottomless cylindrical socket allows the liquid to fill the space between the socket and the stone.

By virtue of the present invention, each article of jewelry comprising a decorative element that is movable in a liquid will make it possible to benefit from the beauty of a precious stone rotating on itself, by giving the impression that it is pivoting in a vacuum and in slow motion, which makes its effect even more spectacular.

Of course, the present invention is not limited to the examples cited and described and, for example, it is possible to envision different types of inserts in the sockets such as, for example, diamond, ruby, mother-of-pearl, metal, etc. In the same way, the stone can be inserted into the socket by different techniques, such as, for example, by being chased, fretted, cast, bonded, etc.

As has been mentioned above, the invention is not limited to watches and is instead applicable to all sorts of articles, in particular jewelry articles such as rings and pendants, and also to spectacles, even pens or other writing instruments. It would also be possible to envision articles, with movable decorative elements according to the invention, associated with luxury leather articles such as handbags. In general, these decorative elements movable in the liquid can be applied to any utilitarian article in order to provide the latter with an original esthetic effect. In particular, it is possible to include several decorative elements of different types in one article in order to produce a unique esthetic effect.

What is claimed is:

1. An article of jewelry comprising:

at least one transparent wall which forms a housing provided to receive at least one precious or semi-precious stone which is immersed and movable in a transparent liquid in said housing; and at least one part which is movable in the liquid and which has the same refractive index as the liquid, said part being immersed in the liquid, wherein the housing is delimited by an upper wall formed by said transparent wall and a lower wall, the internal faces of said upper and lower walls are preferably parallel to each other, and in that the stone is inserted into the part in order to form a movable decorative element, said part is immersed in the liquid and has an axis of revolution and two guide surfaces which are respectively adjacent to the internal faces and which allow said movable decorative element to move freely in translation and in rotation in said liquid about said axis of revolution inside said housing.

2. The article of jewelry as claimed in claim 1, in which the at least one part is a socket or a sphere surrounding the stone.

3. The article of jewelry as claimed in claim 1, in which there is at least one space, between the interior of the part and the stone, filled with the liquid.

4. The article of jewelry as claimed in claim 1, in which the part is arranged to receive a plurality of stones.

5. The article of jewelry as claimed in claim 4, in which the stones have different densities and are arranged so as to orient the movements of the part.

6. The article of jewelry as claimed in claim 1, in which the part has a drag coefficient in the liquid which determines the movement of the movable decorative element.

7. The article of jewelry as claimed in claim 1, in which the movable decorative element is arranged to move in a corridor or along a path defined by protrusions or hollows arranged on at least one of said walls.

8. The article of jewelry as claimed in claim 1, in which the stone is held in the part by a plurality of arms which extend above a body of the part and which set the stone, these arms leaving between them, and above the body of the part, lateral openings allowing the sides of the stone, between the arms, to be in direct contact with the liquid, and said guide surface is formed by the free ends of said arms in the form of separate contact zones spaced apart from one another around the periphery of the open external face of the part.

9. The article of jewelry as claimed in claim 1, in which the stone is a precious stone, in particular a diamond.

10. The article of jewelry as claimed in claim 1, in which the precious or semi-precious stone and the part have a corresponding shape, among others generally cylindrical, oval, square, triangular or asymmetrical.

11. The article of jewelry as claimed in claim 1, in which the clearance between the height of the movable decorative element and the opposite internal faces of said walls is from 0.05 to 0.3 mm and preferably from 0.05 to 0.1 mm.

12. The article of jewelry as claimed in claim 1, in which the parallel internal faces of the walls are flat.

13. The article of jewelry as claimed in claim 1, in which the parallel internal faces of the walls are curved.

14. The article of jewelry as claimed in claim 1, in which the walls are made of sapphire or a material having a hardness comparable to that of sapphire.

15. The article of jewelry as claimed in claim 1, in which said two walls are transparent.

16. The article of jewelry as claimed in claim 1, in the form of a watch; a writing instrument; a jewel; a spectacle frame; or a fine-leatherwear article.

17. The article of jewelry as claimed in claim 2, in which said part forming a socket has a cylinder shape.

18. The article of jewelry as claimed in claim 1, in which said stone is either in said part in the form of a solid sphere, or is included into said part in the form a hollow sphere surrounding said stone and filled with said liquid.

19. The article of jewelry as claimed in claim 1, wherein the movable decorative element is more than one movable decorative element, each movable decorative element having a shape and dimension different from the other more than one movable decorative elements.

20. An article of jewelry comprising:

a housing comprising a transparent upper wall and a lower wall spaced apart from the upper wall, the housing being filled with a transparent liquid;

a decorative element within the housing and comprising a first socket and a stone, the stone being in the first socket and the decorative element being immersed in the liquid, the first socket having a same refractive index as the liquid, the transparent liquid in the housing configured to impact a speed of movement of the decorative element; and a second socket within the housing and lacking a stone, the second socket having a same refractive index as the liquid and being immersed in the liquid, the second socket configured to impact a movement of the decorative element.

* * * * *